US009114639B2

(12) United States Patent
Sasaki

(10) Patent No.: US 9,114,639 B2
(45) Date of Patent: Aug. 25, 2015

(54) RECORDING APPARATUS AND DRYING METHOD

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/337,982

(22) Filed: Jul. 22, 2014

(65) Prior Publication Data

US 2015/0029278 A1 Jan. 29, 2015

(30) Foreign Application Priority Data

Jul. 23, 2013 (JP) ..... 2013-152680

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 3,854,224 | A * | 12/1974 | Yamaji et al. | 34/77 |
| 5,296,873 | A * | 3/1994 | Russell et al. | 346/25 |
| 6,397,488 | B1 * | 6/2002 | Brinkly | 34/92 |
| 6,439,712 | B1 | 8/2002 | Mizutani et al. | |
| 6,463,674 | B1 * | 10/2002 | Meyers et al. | 34/304 |
| 2003/0179260 | A1 * | 9/2003 | Anderson et al. | 347/25 |
| 2004/0189773 | A1 * | 9/2004 | Masumi et al. | 347/102 |
| 2014/0125750 | A1 * | 5/2014 | Sasaki et al. | 347/104 |

FOREIGN PATENT DOCUMENTS

| | | |
|---|---|---|
| JP | 05-330033 | 12/1993 |
| JP | 08-224871 | 9/1996 |
| JP | 2012-045855 | 3/2012 |
| JP | 2012-232533 | 11/2012 |
| JP | 2013-028089 | 2/2013 |
| JP | 2013-028094 | 2/2013 |

* cited by examiner

*Primary Examiner* — Stephen Meier
*Assistant Examiner* — John P Zimmermann
(74) *Attorney, Agent, or Firm* — Workman Nydegger

(57) ABSTRACT

A recording apparatus includes an electromagnetic wave irradiation section that dries ink present on a recording medium by using electromagnetic waves; and a fan that moves vapor evaporated from the ink, which is generated on a back side of the recording medium by irradiating the electromagnetic waves by the electromagnetic wave irradiation section, in a direction away from the recording medium.

14 Claims, 6 Drawing Sheets

RECORDING APPARATUS AND DRYING METHOD

BACKGROUND

1. Technical Field

The present invention relates to a recording apparatus and a drying method.

2. Related Art

In the related art, recording apparatuses including a heater for drying ink ejected onto a recording medium are used. Among them, a recording apparatus including an electromagnetic wave irradiation section irradiating electromagnetic waves to the recording medium in order to dry the ink ejected onto the recording medium, is frequently used. For example, a recording apparatus including a heater irradiating the electromagnetic waves such as a halogen heater or a sheath heater is disclosed in JP-A-2013-28094 and JP-A-2012-45855.

Further, a recording apparatus including a platen as a medium support section that supports the recording medium and a fan that is provided in a lower section of the platen for adsorbing the recording medium to the platen is disclosed in JP-A-2013-28089.

However, as disclosed in JP-A-2013-28094 and JP-A-2012-45855, in the recording apparatus including the heater of the electromagnetic wave irradiation type such as infrared rays of the related art, vapor evaporated from the ink ejected onto the recording medium is condensed on the medium support section and the recording medium may be wet.

Moreover, in the recording apparatus disclosed in JP-A-2013-28089, the fan is provided only in the lower section of the platen to adsorb the recording medium to the platen and the vapor evaporated from the ink ejected onto the recording medium is condensed in the medium support section, and the fan is not intended to suppress the wetness of the recording medium.

SUMMARY

Then, an advantage of some aspects of the invention is to suppress that vapor evaporated from ink by electromagnetic wave irradiation is condensed in a medium support section.

According to an aspect of the invention, a recording apparatus includes: an electromagnetic wave irradiation section that dries ink present on a recording medium by using electromagnetic waves; and a fan that moves vapor evaporated from the ink, which is generated on a back side of the recording medium by irradiating the electromagnetic waves by the electromagnetic wave irradiation section, in a direction away from the recording medium.

Here, the term "the back side of the recording medium" means the opposite side of the recording surface of the recording medium.

In this case, it is possible to move the vapor in a direction away from the recording medium by the fan, which is generated on the back side of the recording medium by evaporating and drying the ink ejected onto the recording medium by the irradiation of the electromagnetic waves. Therefore, it is possible to immediately remove the vapor generated in the portion of the back side of the recording medium and it is possible to suppress dew condensation of the vapor in the portion of the back side of recording medium.

It is preferable that the recording apparatus further include a medium support section that supports the recording medium in an irradiation region of the electromagnetic wave irradiation section and has an opening section through which the vapor passes from a support surface of the recording medium to the opposite side thereof, in which the fan moves the vapor from the support surface of the recording medium through the opening section.

In this case, the fan moves the vapor from the support surface of the recording medium to the opposite side thereof through the opening section. Thus, it is possible to suppress stagnation and dew condensation of the vapor on the side of the support surface of the recording medium in the medium support section.

It is preferable that the opening section of the recording apparatus have an opening rate of 40% or greater with respect to the medium support section.

In this case, since the opening rate of the opening section is as high as 40% or more with respect to the medium support section, the vapor is likely to be removed from a periphery of the medium support section and it is possible to suppress the dew condensation of the vapor with high accuracy in the medium support section.

It is preferable that the medium support section of the recording apparatus be configured of a linear member of which a diameter of at least a part thereof is 0.3 mm or less.

In this case, the medium support section is configured of the linear member of which the diameter of at least a part thereof is 0.3 mm or less. A region having a certain area is necessary for the dew condensation of the vapor. It is possible to reduce the area other than the opening section by configuring the opening section using the linear member of which the diameter of at least a part thereof is 0.3 mm or less. Thus, it is possible to reduce the region of the certain area and it is possible to suppress the dew condensation of the vapor with high accuracy in the medium support section because it is difficult for the vapor to condense in the portion in contact with the recording medium.

It is preferable that the recording apparatus further include a medium support section that supports the recording medium on a support surface in a state where a gap is present between the recording medium and the support surface of the recording medium in an irradiation region of the electromagnetic wave irradiation section, in which the fan moves the vapor from the gap.

In this case, since the medium support section supports the recording medium on the support surface in a state where the gap is present between the recording medium and the support surface of the recording medium, it is possible to reduce a transportation load by reducing a contact area between the recording medium and the support surface.

Further, the vapor is collected in the gap by having the gap between the recording medium and the support surface of the recording medium, but since the fan moves the vapor from the gap, it is possible to release the vapor in the gap and to suppress the dew condensation of the vapor in the gap portion.

It is preferable that the recording apparatus further include a recovery section that recovers the vapor as liquid by condensing the vapor.

In this case, since the recovery section recovers the vapor as the liquid by condensing the vapor, it is possible to reduce emission of the vapor based on the ink to the environment.

It is preferable that the recording apparatus further include a medium support section that supports the recording medium in an irradiation region of the electromagnetic wave irradiation section, in which at least a part of the recovery section has thermal conductivity higher than that of the medium support section.

In this case, at least a part of the recovery section has the thermal conductivity higher than that of the medium support section. That is, since the thermal conductivity of at least a part of the recovery section is higher than that of the medium support section, heat that is transmitted via the vapor and the like generated as a result of the irradiation of the electromagnetic waves of the electromagnetic wave irradiation section is easily released and the temperature thereof is lower than that of the medium support section thereby easily condensing the vapor. Thus, it is possible to suppress the dew condensation of the vapor in the medium support section by condensing the vapor in the recovery section.

It is preferable that the recording apparatus further include a second vapor moving section that moves the vapor generated on a side of a recording surface of the recording medium by irradiating the electromagnetic waves by the electromagnetic wave irradiation section in the direction away from the recording medium.

In this case, the second vapor moving section is included, which moves the vapor generated on the side of the recording surface of the recording medium by irradiating the electromagnetic waves by the electromagnetic wave irradiation section to the direction away from the recording medium. Thus, it is possible to move the vapor in both the side of the recording surface of the recording medium and the opposite side thereof, and it is possible to effectively suppress the dew condensation of the vapor.

It is preferable that the second vapor moving section of the recording apparatus have an intake port absorbing the vapor, and that the intake port be positioned on an upper side in the vertical direction with respect to the irradiation region of the electromagnetic wave irradiation section.

Here, the term "positioned on the upper side in the vertical direction with respect to the irradiation region" is not limited to just above the irradiation region and is used to mean that a position may be good where the coming up vapor is absorbed even though the position is slightly deviated.

In this case, the intake port is positioned on the upper side in the vertical direction with respect to the irradiation region of the electromagnetic wave irradiation section. Thus, it is possible to effectively absorb the vapor. It is because the vapor is likely to move upward in the vertical direction because the vapor is heated. That is, it is possible to effectively suppress the dew condensation of the vapor.

It is preferable that the recording apparatus further include a medium support section that supports the recording medium in an irradiation region of the electromagnetic wave irradiation section, in which the medium support section is inclined in a range of 10° or more and 60° or less with respect to an installation surface of the recording apparatus.

In this case, it is possible to reduce the size of the recording apparatus compared to a recording apparatus having a configuration in which the medium support section is not inclined with respect to the installation surface of the recording apparatus.

It is preferable that the recording apparatus further include a medium support section that supports the recording medium in an irradiation region of the electromagnetic wave irradiation section, in which an irradiation length of the electromagnetic waves of the electromagnetic wave irradiation section in a lateral direction of the recording medium is equal to or greater than a length of the medium support section in the lateral direction.

Here, the term "equal to" of "equal to or greater than the length of the medium support section in the lateral direction" means that a case where the length is slightly shorter than the length of the medium support section in the lateral direction is also included.

In this case, the irradiation length of the electromagnetic waves of the electromagnetic wave irradiation section in the lateral direction is equal to or greater than the length of the medium support section in the lateral direction. Thus, it is possible to reduce a temperature difference of the medium support section in the lateral direction and it is possible to suppress occurrence of the dew condensation in the end section and the like of the medium support section in the lateral direction.

It is preferable that as the recording medium of the recording apparatus, at least one of fabric and polyester be usable.

Here, the term "fabric" means textile products such as cloth or textile of which a raw thread is cotton, hemp, silk or a mix thereof and, for example, textile products such as broadcloth, sheeting and the like which are used as a material of the clothing such as a blouse, a shirt, and work clothes may be exemplified.

In this case, as the recording medium, at least one of fabric and polyester may be used. In the recording medium, the vapor is likely to pass through to the back side of the recording medium. Also in the recording apparatus capable of using such a recording medium, it is possible to suppress the dew condensation of the vapor.

According to another aspect of the invention, a recording apparatus is configured to move vapor evaporated from ink ejected onto a recording medium, which is generated on a back side of the recording medium by irradiating electromagnetic waves for drying the ink, in a direction away from the recording medium.

In this case, since the recording apparatus is configured to move the vapor evaporated from the ink ejected onto the recording medium, which is generated on the back side of the recording medium by irradiating electromagnetic waves, to the direction away from the recording medium, it is possible to suppress soiling of the recording medium due to the dew condensation of the vapor.

According to still another aspect of the invention, a recording apparatus includes: an electromagnetic wave irradiation section that dries ink present on a recording medium by using electromagnetic waves; and a fan that moves vapor evaporated from the ink, which is generated on a back side of the recording medium, in a direction away from the recording medium when drying the ink.

In this case, since the recording apparatus is configured to move the vapor evaporated from the ink ejected onto the recording medium, which is generated on the back side of the recording medium by irradiating electromagnetic waves, to the direction away from the recording medium, it is possible to suppress soiling of the recording medium due to the dew condensation of the vapor.

According to further still another aspect of the invention, a drying method for drying ink present on a recording medium, includes: drying vapor while moving the vapor by a fan, which is evaporated from ink ejected onto the recording medium, which is generated on a back side of the recording medium by irradiating electromagnetic waves by an electromagnetic wave irradiation section, in a direction away from the recording medium.

In this case, since the vapor is moved that is evaporated from the ink ejected onto the recording medium, which is generated on the back side of the recording medium by irradiating electromagnetic waves, to the direction away from the recording medium, it is possible to suppress soiling of the recording medium due to the dew condensation of the vapor.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
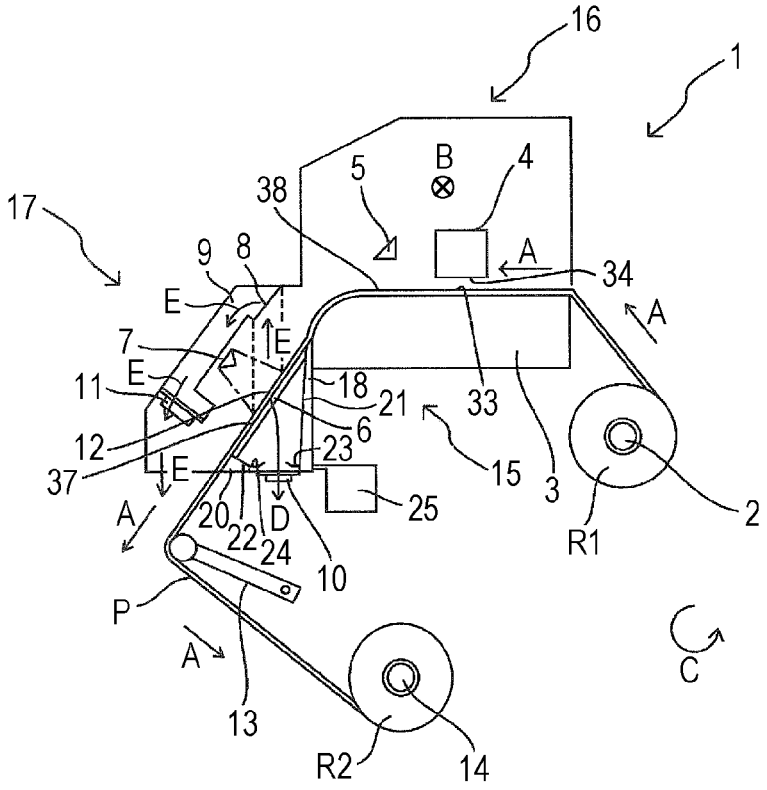
FIG. 1 is a schematic side view illustrating a recording apparatus according to a first embodiment of the invention.
Figure 2:
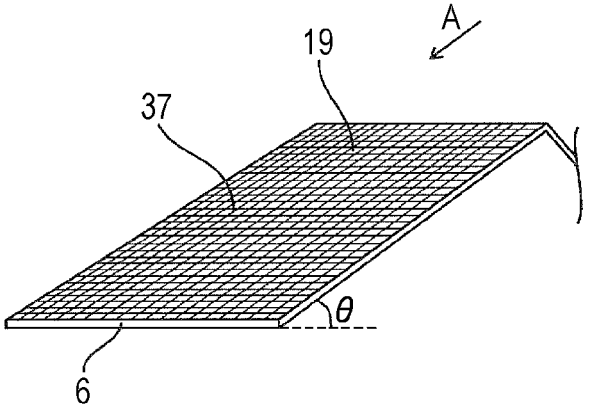
FIG. 2 is a schematic perspective view illustrating a medium support section in the recording apparatus according to the first embodiment of the invention.
Figure 3:
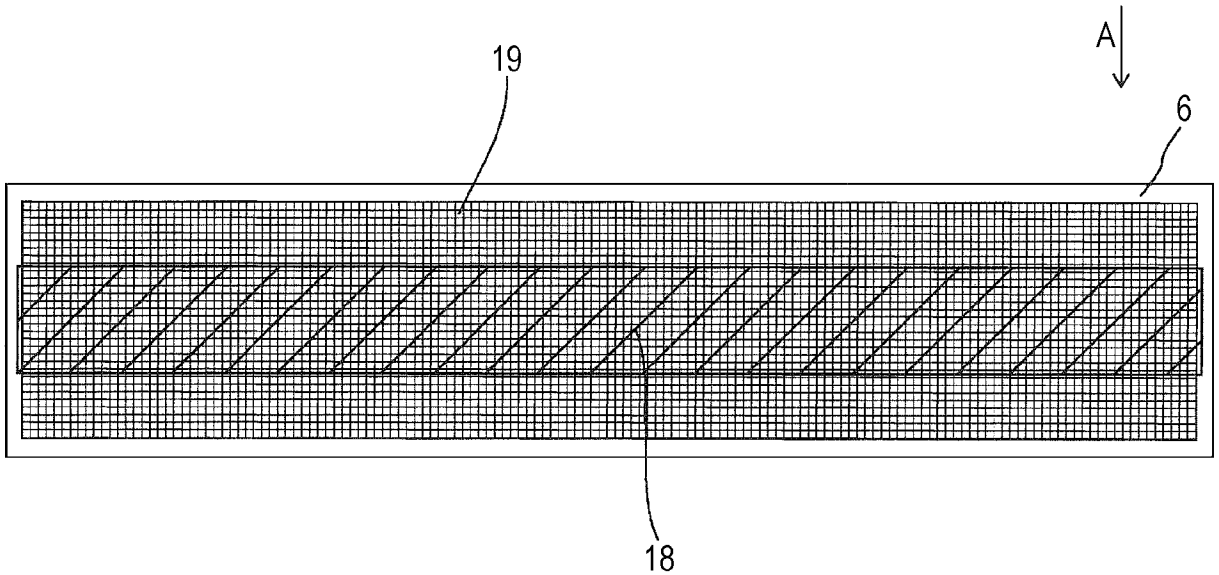
FIG. 3 is a schematic plan view illustrating the medium support section in the recording apparatus according to the first embodiment of the invention.

FIGS. 1 to 3

Hereinafter, a recording apparatus of a first embodiment is described in detail with reference to the accompanying drawings.

First, the recording apparatus according to the embodiment is described. The recording apparatus is a recording apparatus capable of recording on a recording medium by an aqueous ink, but is not limited to the recording apparatus capable of using the aqueous ink. Further, the recording apparatus is a so-called after heater type recording apparatus including a drying mechanism having a vapor moving section at a position different from a recording region (a position capable of facing a nozzle surface of a recording head), but is not limited to such a recording apparatus and may be a recording apparatus including the drying mechanism having the vapor moving section in the recording region. Further, the recording apparatus is a recording apparatus that performs recording by transporting the recording medium with respect to the recording head, but may be a so-called flatbed type recording apparatus that moves the recording head with respect to a medium support section.

FIG. 1 illustrates a schematic side view of a recording apparatus 1 according to the embodiment.

The recording apparatus 1 of the embodiment includes a set section 2 that sets a roll R1 capable of feeding a recording medium P for performing the recording. Moreover, the recording apparatus 1 of the embodiment uses a roll type recording medium as the recording medium P, but is not limited to the recording apparatus using the roll type recording medium. For example, the recording apparatus may use a single sheet type recording medium.

In the recording apparatus 1 of the embodiment, when transporting the recording medium P in a transportation direction A, the set section 2 rotates in a rotation direction C.

Further, the recording apparatus 1 of the embodiment includes a transportation mechanism 15 having a plurality of transportation rollers (not illustrated) in the vicinity of a platen 3 for transporting the roll type recording medium P in the transportation direction A. The set section 2 rotates in the rotation direction C, the plurality of transportation rollers (not illustrated) of the transportation mechanism 15 rotate, and a winding section 14 described below rotates in the rotation direction C, thereby transporting the recording medium P in the transportation direction A. A moving route of the recording medium P in the transportation is a transportation route of the recording medium P.

Further, the recording apparatus 1 of the embodiment includes a recording mechanism 16 that performs recording by reciprocally scanning a recording head 4 in a scanning direction B crossing the transportation direction A of the recording medium P. The recording head 4 performs the recording by ejecting ink from nozzles to the recording medium P in a recording region 33 among the transportation route of the recording medium P by the transportation mechanism 15. An image is formed (recorded) on the recording medium P by the ink ejected from the recording head 4. Moreover, the recording apparatus 1 of the embodiment includes the recording mechanism 16 that performs the recording by reciprocally moving the recording head 4, but may be a recording apparatus including a so-called line head in which a plurality of nozzles ejecting the ink are provided in a direction crossing the transportation direction A.

Here, the term "the line head" is a recording head used in the recording apparatus in which a region of the nozzles formed in the cross direction crossing the transportation direction A of the recording medium P is provided to be capable of covering an entirety of the recording medium P in the cross direction, one of the recording head and the recording medium is fixed and the other is moved, thereby forming the image. Moreover, the region of the nozzles of the line head in the cross direction may be capable of covering all recording media P, which are applicable to the recording apparatus, in the cross direction.

Further, in the embodiment, the transportation direction A corresponds to a longitudinal direction of the recording medium P and the cross direction (the scanning direction B) crossing the transportation direction A corresponds to a lateral direction of the recording medium P.

Further, here, a region facing the recording head 4 when performing the recording on the recording medium P is the recording region 33, specifically, a region facing a configuration region of the nozzles (not illustrated) ejecting the ink provided on a nozzle forming surface 34 of the recording head 4 is the recording region 33. Moreover, in order to evaporate a portion of volatile components of the ink ejected onto the recording medium P in the recording region 33, an electromagnetic wave irradiation type platen heater 5 irradiating electromagnetic waves such as infrared rays capable of heating the recording region 33 to 50° C. to 60° C. is provided in the recording mechanism 16.

As the electromagnetic waves, the infrared rays are preferably used and a wavelength thereof is 0.76 μm to 1000 μm. In general, the infrared rays are further divided by near infrared rays, mid-infrared rays, and far infrared rays by the wavelength, and even though definition of the division may vary, wavelength regions are approximately 0.78 μm to 2.5 μm, 2.5 μm to 4.0 μm and 4.0 μm to 1000 μm. Particularly, the mid-infrared rays are preferably used.

A drying mechanism 17 is provided on the downstream side of the recording head 4 in the transportation direction A of the recording medium P. The drying mechanism 17 includes an electromagnetic wave irradiation section 7 capable of irradiating the electromagnetic waves such as the infrared rays to the recording medium P that is recorded by the recording head 4. Further, the drying mechanism 17 includes a medium support section 6 that supports the recording medium P in a support region including an irradiation region 12 of the electromagnetic waves of the electromagnetic wave irradiation section 7 and has an opening section 19 (see FIG. 2) through which vapor evaporated from the ink ejected onto the recording medium P by heating to approximately 100° C. to 120° C. by the electromagnetic wave irradiation by the electromagnetic wave irradiation section 7 passes. In the irradiation region 12, the ejected ink is heated to approximately 100° C. to 120° C. by the electromagnetic wave irradiation by the electromagnetic wave irradiation section 7.

A fan 10 as a first vapor moving section that generates an air flow moving the vapor generated in a back side (opposite to a recording surface 38) of the recording medium P by irradiating of the electromagnetic waves by the electromagnetic wave irradiation section 7 is provided on the opposite side of a support surface 37 supporting the recording medium P in the medium support section 6. The fan 10 generates the air flow in a direction D in which the vapor passes through the opening section 19 from the side of the support surface 37 of the recording medium P to the opposite side. In other words, the fan 10 moves the vapor from the side of the support surface 37 of the recording medium P through the opening section 19. That is, the fan 10 moves the vapor in a direction away from the recording medium, which is generated on the back side of the recording medium P by evaporating and drying the ink ejected onto the recording medium P by the irradiation of the electromagnetic waves. Therefore, it is possible to immediately remove the vapor generated in the portion of the back side of the recording medium P and it is possible to suppress dew condensation of the vapor in the portion of the back side of recording medium.

Here, the term "generating the air flow that moves the vapor" means that it is not enough simply to generate the air flow on the back side of the recording medium P but means that generating the air flow for moving the vapor is required. Thus, for example, the vapor moving section in the recording apparatus in which the recording medium P is adsorbed to the medium support section is not applicable to "the first vapor moving section" described above because the vapor moving section cannot generate the air flow that moves the vapor by blocking the opening section of the medium support section by adsorbing the recording medium P to the medium support section.

Since the recording apparatus 1 of the embodiment includes the fan 10 generating the air flow that moves the vapor, it is possible to suppress stagnation and dew condensation of the vapor on the side of the support surface 37 of the recording medium P in the medium support section 6.

Moreover, the air flow of the direction D contains the vapor. The recording apparatus 1 of the embodiment includes a dew condensation section 18, a dew condensation section 20 and a liquid waste tank 25 configuring a recovery section for recovering the vapor by condensing the vapor. The air flow containing the vapor in the direction D condenses the vapor in a dew condensation surface 21 of the dew condensation section 18 and a dew condensation surface 22 of the dew condensation section 20. Then, liquid generated by the dew condensation is recovered to the liquid waste tank 25 through a gutter 23 provided in the dew condensation section 18 and a gutter 24 provided in the dew condensation section 20. Thus, release of the vapor evaporated from the ink is suppressed and emission of the vapor based on the ink to the environment is reduced.

Here, in the embodiment, the dew condensation section 18 and the dew condensation section 20 configuring the recovery section have thermal conductivity higher than that of the medium support section 6. Thus, in the dew condensation section 18 and the dew condensation section 20, heat that is transmitted via the vapor and the like generated as a result of the irradiation of the electromagnetic waves of the electromagnetic wave irradiation section 7 is easily released and the temperature thereof is lower than that of the medium support section 6 thereby easily condensing the vapor. That is, the dew condensation of the vapor is suppressed in the medium support section 6 by condensing the vapor in the dew condensation section 18 and the dew condensation section 20. Moreover, if at least a part of the dew condensation section 18 and the dew condensation section 20 configuring the recovery section has the thermal conductivity higher than that of the medium support section 6, it is possible to suppress the dew condensation of the vapor in the medium support section 6.

Further, a fan 11 as a second vapor moving section that generates the air flow that moves the vapor generated on the side of the recording surface 38 of the recording medium P by irradiating the electromagnetic waves by the electromagnetic wave irradiation section 7 is provided in the drying mechanism 17. In other words, the fan 11 moves the vapor in a direction away from the recording medium P. Thus, the recording apparatus 1 of the embodiment is configured such that it is possible to move the vapor in both sides of the side of the recording surface 38 of the recording medium P and the opposite side thereof, and it is possible to suppress the dew condensation of the vapor further effectively. However, the invention is not limited to this configuration.

Further, the drying mechanism 17 of the embodiment has an intake port 8 sucking the vapor generated on the side of the recording surface 38 of the recording medium P and a flow path 9 of the vapor as the second vapor moving section, in addition to the fan 11. Then, the fan 11 generates the air flow in a direction E in which the vapor generated on the side of the recording surface 38 of the recording medium P is directed to the outside of the recording apparatus 1 through the intake port 8 and the flow path 9.

Further, a tension adjustment section 13 having a role of adjusting the tension of the recording medium P when winding the recording medium P is provided on the downstream side of the drying mechanism 17 in the transportation direction A of the recording medium P. Then, the winding section 14 capable of winding the recording medium P is provided on the downstream side of the tension adjustment section 13 in the transportation direction A of the recording medium P. Moreover, in the recording apparatus 1 of the embodiment, the winding section 14 rotates in the rotation direction C when forming a roll R2 of the recording medium P.

Next, the medium support section 6 is described in detail.

FIG. 2 is a schematic perspective view illustrating the medium support section 6 of the embodiment.

The opening section 19 is provided in the medium support section 6. That is, the opening section 19 is provided through which the vapor evaporated from the ink ejected onto the recording medium P passes from the side of the recording medium P to the opposite side thereof with respect to the medium support section 6. The opening section 19 has a role of passing the vapor evaporated from the ink from one surface side to the other surface side of the medium support section 6.

The vapor evaporated from the ink by the electromagnetic wave irradiation is capable of releasing in the direction away from the portion facing the recording medium P of the medium support section 6 through the opening section 19, that is, from a contact region between the medium support section 6 and the recording medium P by providing the opening section 19. Therefore, it is possible to easily reduce existence amount of the vapor that is a source of the dew condensation in the periphery of the medium support section and then the dew condensation is unlikely to occur in the periphery of the medium support section.

The shape of the opening section 19 is not particularly limited and may be circular, polygonal and the like as long as the structure is capable of passing the vapor.

As a preferable configuration example of the opening section 19, a quadrangle in which linear members, of which a diameter of at least a part thereof is 0.3 mm or less, are configured to be arranged in a grid shape is exemplified. A region having a certain area is necessary for the dew condensation of the vapor. Since the area other than the opening section can be reduced by configuring the opening section using the linear members of which the diameter of at least a part thereof is 0.3 mm or less, it is possible to reduce the region of the certain area and it is possible to suppress the dew condensation of the vapor with high accuracy in the contact portion with the recording medium P in the medium support section 6.

Further, an opening rate of the opening section 19 with respect to the medium support section 6 is preferably 40% or more. This is because the vapor is likely to be removed away from the periphery of the medium support section 6 and it is possible to suppress the dew condensation of the vapor with high accuracy in the medium support section 6.

Further, the medium support section 6 of the embodiment is provided to be inclined in a range of 10° or more and 60° or less with respect to an installation surface of the recording apparatus 1. That is, an inclination angle θ illustrated in FIG. 2 is 10° or more and 60° or less. Thus, it is possible to reduce the size of the recording apparatus compared to a recording apparatus configured not to be inclined with respect to the installation surface of the recording apparatus. Then, as illustrated in FIG. 1, the intake port 8 is positioned on the upper side in the vertical direction with respect to the irradiation region of the electromagnetic wave irradiation section 7.

Here, the term "positioned on the upper side in the vertical direction with respect to the irradiation region" is not limited to just above the irradiation region and is used to mean that a position may be good where the coming up vapor is absorbed even though slightly deviated.

Since the recording apparatus 1 of the embodiment has such a configuration, in a general case where the installation surface is the horizontal surface, the intake port 8 can effectively absorb the vapor likely to move on the upper side in the vertical direction because the vapor is heated. That is, the recording apparatus 1 of the embodiment effectively suppresses the dew condensation of the vapor in the medium support section 6.

Moreover, a material of the medium support section 6 is not particularly limited and metal such as stainless steel or aluminum, plastics such as polyphenylene sulfide or polyether ether ketone, those obtained by adding a reinforcing member such as glass fiber or carbon fiber to the plastic and the like may be used. Further, for example, different materials may be used in an end section and a center section of the medium support section.

FIG. 3 is a schematic plan view illustrating the medium support section 6 of the embodiment.

As illustrated in the dew condensation section 18 of the electromagnetic waves of the electromagnetic wave irradiation section 7 in FIG. 3, the irradiation length of the electromagnetic waves of the electromagnetic wave irradiation section 7 in the cross direction crossing the transportation direction A corresponds to the length of the medium support section 6 in the cross direction.

Here, the term "the length of the medium support section 6 in the cross direction" may be a length including an outer frame in a case where the medium support section 6 has the outer frame, and may also be a length of a region in which the opening section 19 is provided without including the outer frame.

Further, the term "corresponding to the length of the medium support section 6 in the cross direction" means that the length is equal to or greater than the length of the medium support section 6 in the cross direction, and "equal to" means to include a case of being slightly shorter than the length of the medium support section 6 in the cross direction. In the embodiment, if the length of the medium support section 6 in the cross direction is the length including the outer frame, the irradiation length is slightly shorter than the length of the medium support section 6, and if the length of the medium support section 6 in the cross direction is the length of the region in which the opening section 19 is provided without including the outer frame, the irradiation length is slightly longer than the length of the medium support section 6. Meanwhile, the term "corresponding to the length of the medium support section 6 in the cross direction" also means that a case where the irradiation length is longer than the length of the medium support section 6 including the outer frame in the cross direction and a case where the irradiation length is slightly shorter than the length of the medium support section 6 without including the outer frame in the cross direction are included.

In the recording apparatus 1 of the embodiment, the irradiation length of the electromagnetic waves of the electromagnetic wave irradiation section 7 in the cross direction corresponds to the length of the medium support section 6 in the cross direction. Thus, a temperature difference in the medium support section 6 in the cross direction is reduced and occurrence of the dew condensation in the end section and the like of the medium support section 6 in the cross direction is suppressed.

Moreover, in the recording apparatus 1 according to the embodiment, as the recording medium P, at least one of fabric and polyester may be used.

Here, the term "fabric" means textile products such as cloth or textile of which a raw thread is cotton, hemp, silk or mixed thereof and, for example, textile products such as broadcloth, sheeting and the like which are used as a material of the clothing such as a blouse, a shirt, and work clothes may be exemplified.

Further, a coating sheet of which a surface is coated, a backside releasable film, rayon, and a synthetic paper may be used.

The recording apparatus 1 of the embodiment may use at least one of fabric and polyester as the recording medium P. In the recording medium P, the vapor is likely to pass through to the back side of the recording medium P. However, in the recording apparatus 1 of the embodiment, it is possible to suppress the dew condensation of the vapor by the configuration described above even when using such a recording medium P.

Second Embodiment

FIG. 4

Hereinafter, a recording apparatus of a second embodiment is described in detail with reference to the accompanying drawing.

Figure 4:
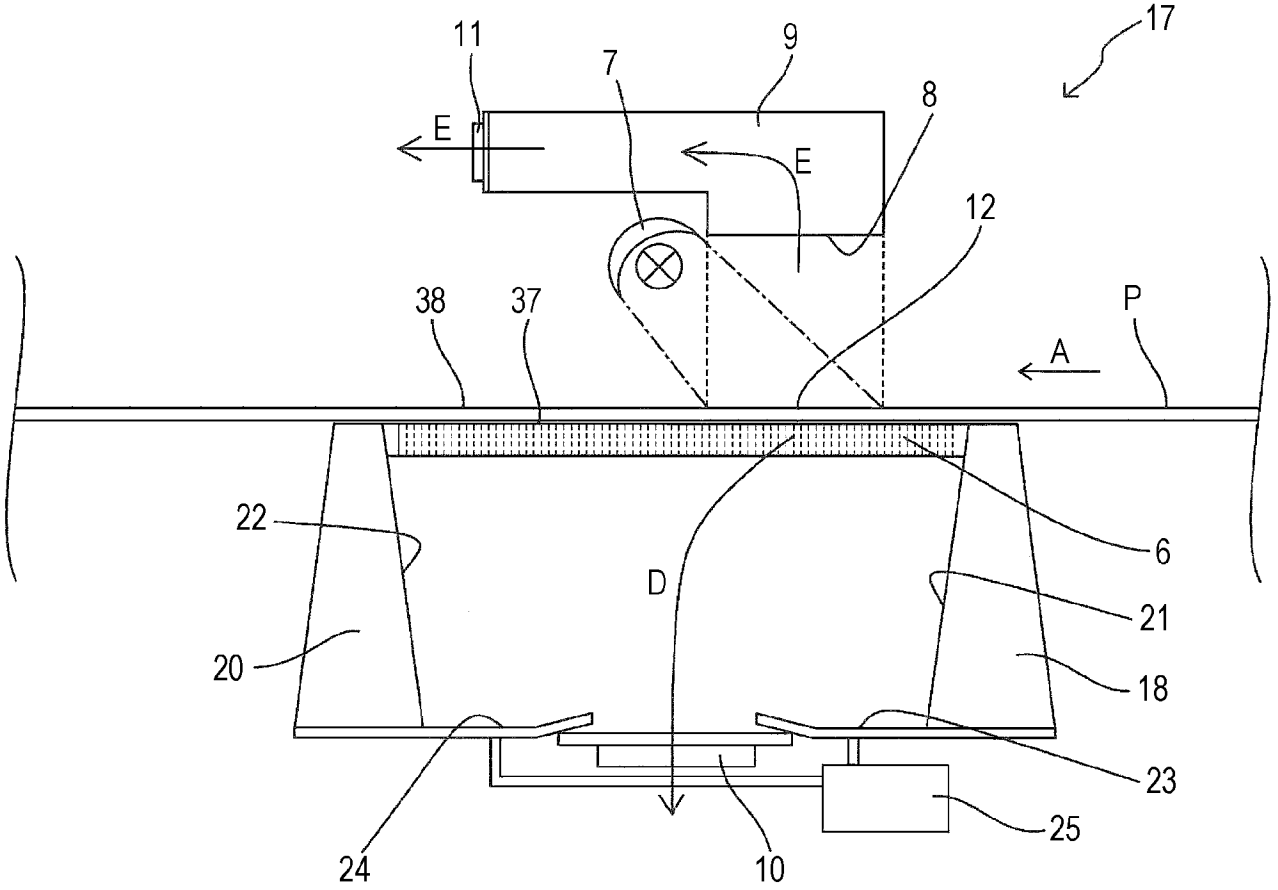
FIG. 4 is a schematic side view illustrating a medium support section in a recording apparatus according to a second embodiment of the invention.

FIG. 4 illustrates a schematic side view of the recording apparatus 1 of the embodiment. Moreover, the same reference numerals are given to the configuration members in common with the above embodiment and the detailed description thereof is omitted.

Moreover, the recording apparatus 1 of the embodiment has the same configuration as the recording apparatus 1 of the first embodiment other than the drying mechanism 17.

In the drying mechanism 17 of the embodiment, the medium support section 6 is provided to be substantially parallel to the installation surface of the recording apparatus 1 and the intake port 8 is provided to face the irradiation region 12 of the electromagnetic wave irradiation section 7. In other words, the intake port 8 is provided on the upper side in the vertical direction with respect to the portion corresponding to the irradiation region 12 of the electromagnetic wave irradiation section 7 in the recording surface 38 of the recording medium P. Thus, it is possible to effectively absorb the vapor. This is because the vapor is likely to move upward in the vertical direction because the vapor is heated. That is, in the recording apparatus 1 of the embodiment, the dew condensation of the vapor is effectively suppressed.

Third Embodiment

Figure 5:
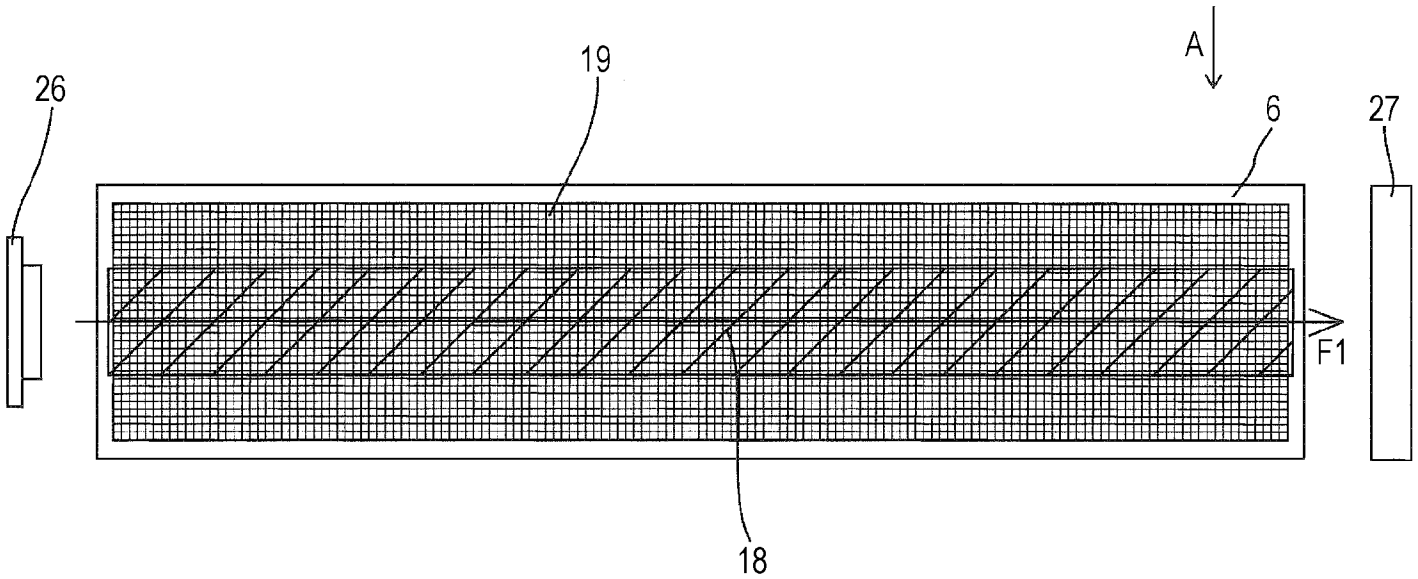
FIG. 5 is a schematic plan view illustrating a medium support section in a recording apparatus according to a third embodiment of the invention.
Figure 6:
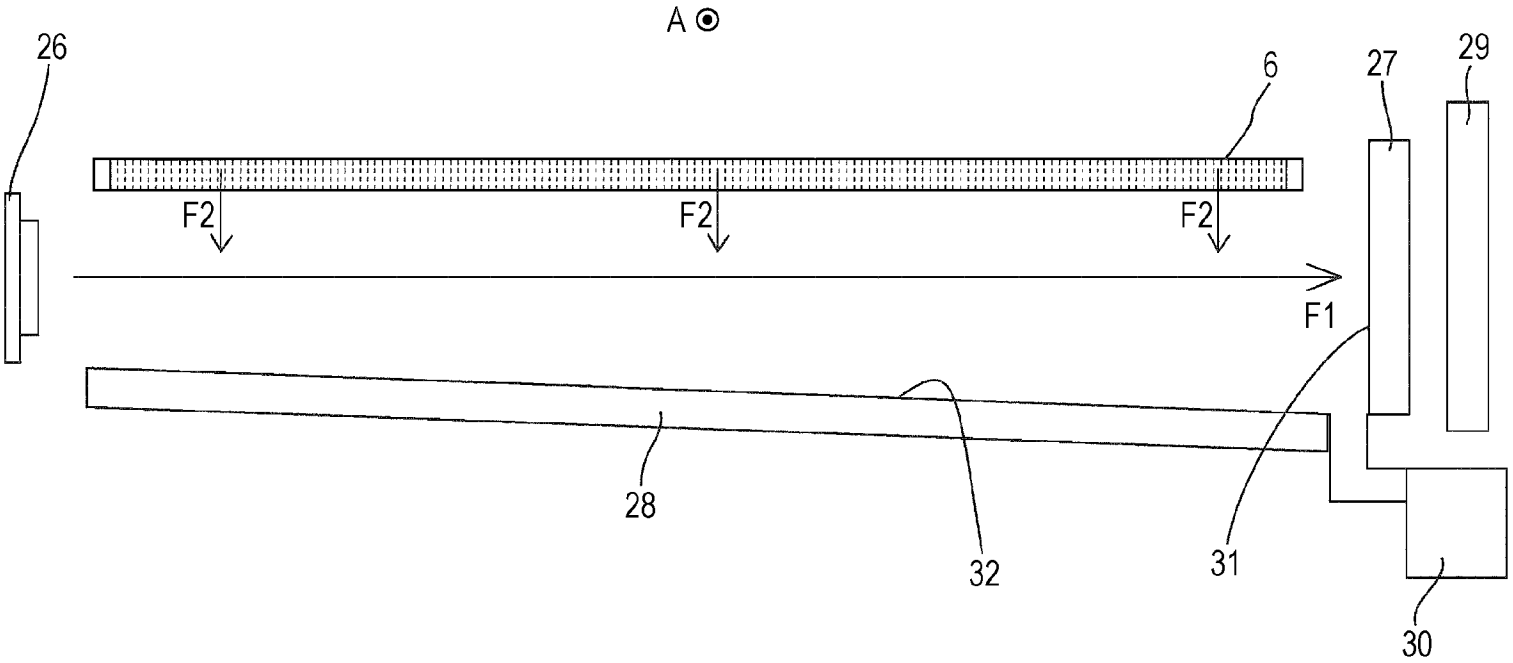
FIG. 6 is a schematic front view illustrating the recording apparatus according to the third embodiment of the invention.

FIGS. 5 and 6

Hereinafter, a recording apparatus of the third embodiment is described in detail with reference to the accompanying drawings.

FIG. 5 illustrates a schematic plan view of the medium support section 6 of the embodiment. Further, FIG. 6 illustrates a schematic front view of the recording apparatus 1 of the embodiment. Moreover, the same reference numerals are given to the common configuration members with the above embodiment and the detailed description thereof is omitted.

Moreover, the recording apparatus 1 of the embodiment has the same configuration as the recording apparatus 1 of the first embodiment other than the drying mechanism 17.

The recording apparatus 1 of the first embodiment and the second embodiment is configured such that the air flow is generated by the fan 10 as the first vapor moving section in the direction D that extends from the side of the medium support section 6 supporting the recording medium P to the outside of the recording apparatus 1 through the opening section 19. That is, the recording apparatus 1 of the first embodiment and the second embodiment is configured such that the vapor is directly generated from the side of the medium support section 6 supporting the recording medium P to the opposite side of the medium support section 6 supporting the recording medium P through the opening section 19.

Meanwhile, in the recording apparatus 1 of the embodiment, the air flow is generated by a fan 26 as the first vapor moving section in a direction F1 crossing the transportation direction A and substantially parallel to the installation surface of the recording apparatus 1. Then, the recording apparatus 1 of the embodiment is configured such that air flow is generated, by the air flow in the direction F1, in a direction F2 that extends from the side of the medium support section 6 supporting the recording medium P to the opposite side of the medium support section 6 supporting the recording medium P through the opening section 19. That is, the recording apparatus 1 of the embodiment is configured such that the air flow is indirectly generated from the side of the medium support section 6 supporting the recording medium P to the opposite side of the medium support section 6 supporting the recording medium P through the opening section 19.

The vapor is directed from the side of the medium support section 6 supporting the recording medium P to the opposite side of the medium support section 6 supporting the recording medium P through the opening section 19 by the air flow in the direction F2 and then is moved to the direction of a dew condensation section 27 as the recovery section by the air flow in the direction F1. Then, the vapor is condensed in a dew condensation surface 31 of the dew condensation section 27 and a dew condensation surface 32 of a dew condensation section 28 as the recovery section by moving of the vapor by the air flow in the direction F1. Then, the liquid that is generated by the condensing in the dew condensation surface 31 and the dew condensation surface 32 is recovered in a liquid waste bottle 30 by flowing along the dew condensation surface 31 and the dew condensation surface 32.

Moreover, the recording apparatus 1 of the embodiment includes a filter 29 that traps the vapor that is not recovered in the dew condensation section 27 and the dew condensation section 28. However, the invention is not limited to this configuration.

Fourth Embodiment

FIG. 7

Hereinafter, a recording apparatus of a fourth embodiment is described in detail with reference to the accompanying drawing.

Figure 7:
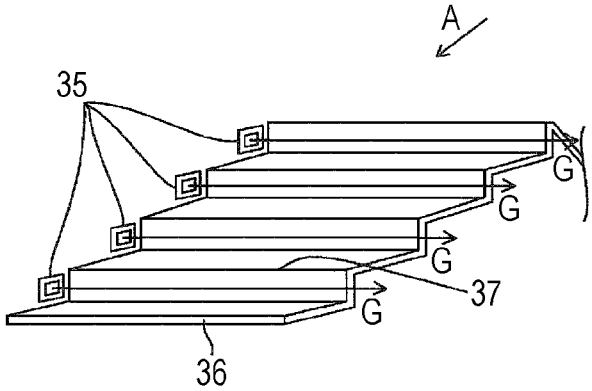
FIG. 7 is a schematic perspective view illustrating a medium support section in a recording apparatus according to a fourth embodiment of the invention.

FIG. 7 illustrates a schematic perspective view of a medium support section 36 of the embodiment. Moreover, the same reference numerals are given to the common configuration members with the above embodiment and the detailed description thereof is omitted.

Moreover, the recording apparatus 1 of the embodiment has the same configuration as the recording apparatus 1 of the first embodiment other than the drying mechanism 17.

The recording apparatus 1 of the first to third embodiments is configured such that the air flow is generated by the fan 10 or the fan 26 as the first vapor moving section in the direction D or the direction F2 that extends from the side of the medium support section 6 supporting the recording medium P to the opposite side of the medium support section 6 supporting the recording medium P through the opening section 19.

Meanwhile, the recording apparatus 1 of the embodiment is configured such that the air flow is generated by a fan 35 as the first vapor moving section in a direction G to a gap (space) generated between the recording medium P and a support surface 37 of a medium support section 36 supporting the recording medium P. In other words, the fan 35 is configured to move the vapor from the gap.

The recording apparatus 1 of the embodiment includes the medium support section 36 supporting the recording medium P on the support surface 37 in a state where the gap is present between the recording medium P and the support surface 37 of the recording medium P in the irradiation region of the electromagnetic wave irradiation section 7. The fan 35 is configured to generate the air flow in the gap. Specifically, the support surface 37 has a step shape in which the cross direction crossing the transportation direction A is a width direction thereof, and the fan 35 is configured to generate the air flow in the direction G along the cross direction.

Since the medium support section 36 supports the recording medium P on the support surface 37 in a state where the gap is present between the recording medium P and the support surface 37 of the recording medium P, a transportation load is reduced by reducing a contact area between the recording medium P and the support surface 37.

Further, the vapor is collected in the gap by having the gap between the recording medium P and the support surface 37 of the recording medium P, but since the fan 35 generates the air flow in the gap, it is possible to release the vapor in the gap and to suppress the dew condensation of the vapor in the gap.

As described above in the first to fourth embodiments, the recording apparatus of the invention includes the electromagnetic wave irradiation section 7 that dries the ink present on the recording medium P by using the electromagnetic waves, and the fan 10 that moves the vapor evaporated from the ink generated on the back side of the recording medium P by irradiating the electromagnetic waves by the electromagnetic wave irradiation section 7 to the direction away from the recording medium P. Thus, it is possible to suppress the dew condensation of the vapor.

Further, in other words, the recording apparatus of the invention is configured such that the vapor evaporated from the ink ejected onto the recording medium P, which is generated on the back side of the recording medium P by irradiation of the electromagnetic waves for drying the ink, is moved in the direction away from the recording medium P. Thus, it is possible to suppress soiling of the recording medium P by the dew condensation of the vapor.

Further, in other words, the recording apparatus of the invention includes the electromagnetic wave irradiation section 7 that dries the ink present on the recording medium P by using the electromagnetic waves and the fan 10 that moves the vapor evaporated from the ink, which is generated on the back side of the recording medium P, to the direction away from the recording medium P when drying the ink. Thus, it is possible to suppress soiling of the recording medium P by the dew condensation of the vapor.

Further, in other words, the drying method of the invention is a drying method for drying the ink present on the recording medium P and performs the drying while moving the vapor by the fan 10, which is evaporated from the ink ejected onto the recording medium P, which is generated on the back side of the recording medium P by irradiating the electromagnetic waves by the electromagnetic wave irradiation section 7, to the direction away from the recording medium P. Thus, it is possible to suppress soiling of the recording medium P by the dew condensation of the vapor.

The entire disclosure of Japanese Patent Application No. 2013-152680, filed Jul. 23, 2013 is expressly incorporated by reference herein.

What is claimed is:

1. A recording apparatus comprising:

a recording mechanism that performs recording on a recording medium while the recording medium is supported on a platen;

a drying mechanism that includes an electromagnetic wave irradiation section that dries ink present on a recording medium by using electromagnetic waves;

a medium supporting section that supports the recording medium in the drying mechanism, wherein the medium supporting section is inclined relative to the platen; and a fan that moves vapor evaporated from the ink, which is generated on a back side of the recording medium by irradiating the electromagnetic waves by the electromagnetic wave irradiation section, in a direction away from the recording medium.

2. The recording apparatus according to claim 1, wherein the medium support section supports the recording medium in an irradiation region of the electromagnetic wave irradiation section and has an opening section through which the vapor passes from a support surface of the recording medium to the opposite side thereof, wherein the fan moves the vapor from the support surface of the recording medium through the opening section.

3. The recording apparatus according to claim 2, wherein the opening section of the medium support section has an opening rate of 40% or more.

4. The recording apparatus according to claim 2, wherein the medium support section is configured of a linear member of which a diameter of at least a part thereof is 0.3 mm or less.

5. The recording apparatus according to claim 1, wherein the medium support section supports the recording medium on a support surface in a state where a gap is present between the recording medium and the support surface of the recording medium in an irradiation region of the electromagnetic wave irradiation section, wherein the fan moves the vapor from the gap.

6. The recording apparatus according to claim 1, further comprising:

a recovery section that recovers the vapor as liquid by condensing the vapor.

7. The recording apparatus according to claim 6, wherein the medium support section supports the recording medium in an irradiation region of the electromagnetic wave irradiation section, wherein at least a part of the recovery section has thermal conductivity higher than that of the medium support section.

8. The recording apparatus according to claim 1, further comprising:

a vapor moving section that moves the vapor generated on a side of a recording surface of the recording medium by irradiating the electromagnetic waves by the electromagnetic wave irradiation section to the direction away from the recording medium.

9. The recording apparatus according to claim 8, wherein the vapor moving section has an intake port absorbing the vapor, and wherein the intake port is positioned on an upper side in the vertical direction with respect to an irradiation region of the electromagnetic wave irradiation section.

10. The recording apparatus according to claim 9, wherein the medium support section supports the recording medium in the irradiation region of the electromagnetic wave irradiation section, wherein the medium support section is inclined in a range of 10° or more and 60° or less with respect to an installation surface of the recording apparatus.

11. The recording apparatus according to claim 1, wherein the medium support section supports the recording medium in an irradiation region of the electromagnetic wave irradiation section, wherein an irradiation length of the electromagnetic waves of the electromagnetic wave irradiation section in a lateral direction of the recording medium is equal to or greater than a length of the medium support section in the lateral direction.

12. The recording apparatus according to claim 1, wherein as the recording medium, at least one of fabric and polyester is usable.

13. A recording apparatus comprising:

a recording mechanism that performs recording on a recording medium while the recording medium that is supported on an installation surface;

a drying mechanism that includes an electromagnetic wave irradiation section that dries ink present on a recording medium by using electromagnetic waves;

a medium supporting section that supports the recording medium in the drying mechanism, wherein the medium supporting section is inclined relative to the installation surface; and a fan that moves vapor evaporated from the ink, which is generated on a back side of the recording medium, in a direction away from the recording medium when drying the ink.

14. A drying method for drying ink present on a recording medium, the method comprising:

performing recording on the recording medium, wherein the recording medium is supported by a platen in a recording area; and drying the recording medium in an irradiation area with an electromagnetic wave irradiation section while the recording medium is supported by a medium support section that is inclined with respect to the platen, wherein vapor is generated while drying the recording medium; and moving the vapor generated while drying the recording medium by a fan, wherein the vapor is evaporated from ink ejected onto the recording medium and wherein the vapor is generated on a back side of the recording medium by irradiating electromagnetic waves by the electromagnetic wave irradiation section, wherein the vapor is moved in a direction away from the recording medium.

* * * * *